United States Patent [19]

Hanson

[11] 4,242,212

[45] Dec. 30, 1980

[54] MANNICH ADDITIVES MODIFIED BY DITERTIARY ALKYL PHENOL

[75] Inventor: Joseph B. Hanson, Wheaton, Ill.

[73] Assignee: Standard Oil Company (Indiana), Chicago, Ill.

[21] Appl. No.: 28,567

[22] Filed: Apr. 9, 1979

[51] Int. Cl.[3] ..... C10M 1/32

[52] U.S. Cl. ..... 252/51.5 R; 44/58; 44/75; 252/51.5 A; 260/566 R

[58] Field of Search ..... 252/51.5 A, 51.5 R; 260/566 R, 570.5 P; 44/58, 75

[56] References Cited

U.S. PATENT DOCUMENTS

| | | | |
|---|---|---|---|
| 2,504,742 | 4/1950 | Smith et al. | 252/51.5 R |
| 2,962,442 | 11/1960 | Andress, Jr. | 252/51.5 R |
| 2,962,531 | 11/1960 | Coffield | 252/51.5 R X |
| 3,036,003 | 5/1962 | Verdol | 252/51.5 R |
| 3,368,972 | 2/1968 | Otto | 252/51.5 R |
| 3,544,520 | 12/1970 | Culbertson et al. | 252/51.5 R |
| 3,872,019 | 3/1975 | Culbertson et al. | 252/51.5 R X |
| 3,948,619 | 4/1976 | Worrel | 44/58 |
| 4,025,316 | 11/1977 | Stover | 44/58 |

*Primary Examiner*—Andrew Metz

*Attorney, Agent, or Firm*—Mark DiPietro; William T. McClain; William H. Magidson

[57] ABSTRACT

Mannich additives formed from a 2,4- or 2,6-ditertiary alkyl "hindered" phenol, a polyamine, a formaldehyde-yielding reagent and at least one substantially hydrocarbon compound with at least one active or acidic hydrogen selected from the group consisting of a para monoalkyl phenol, and an oxidized olefinic polymer, are improved Mannich additives for high temperature internal combustion engine lubrication.

8 Claims, No Drawings

MANNICH ADDITIVES MODIFIED BY DITERTIARY ALKYL PHENOL

This invention relates to improved Mannich lubricant additives for high temperature internal combustion engine operation. More particularly, this invention relates to ditertiary alkyl phenol derivatives of Mannich additive compositions. More particularly, this invention relates to Mannich additives comprising the reaction product of a 2,4- or 2,6-ditertiary alkyl phenol, a substantially hydrocarbon compound having one acidic or active hydrogen such as a para mono-alkyl phenol or an oxidized olefinic polymer, a polyamine and a formaldehyde-yielding reagent, which provides high temperature lubrication properties. The functional group introduced into the Mannich composition by the inclusion of the ditertiary alkyl phenol compounds in the Mannich reaction provides lubricants with unexpected high temperature anti-wear and anti-deposit properties along with the expected anti-oxidant activity.

The industry standard two-cycle engine additive for high temperature operation is apparently the reaction product of about 3 moles of isostearic acid and 1 mole of triethylenetetramine. This reaction product suffers from the disadvantage that it is prepared from isostearic acid. The increased demand for isostearic acid and its parent compound, "dimer"acid, and for additives based on isostearic acid and "dimer" acid has resulted in a relatively short supply of isostearic acid. Further, a continuing need exists for additives which prevent wear and the formation of deposits on engine surfaces.

Mannich additives are made by the condensation of an amine, a formaldehyde-yielding reagent and a substantially hydrocarbon compound having at least one acidic or active hydrogen. Examples of the preparation of said Mannich products are found in U.S. Pat. Nos. 3,539,633; 3,697,574; 3,704,308; 3,736,357; and 3,751,365 which are expressly incorporated by reference herein. Commonly, the substantially hydrocarbon compound having at least one acidic or active hydrogen comprises, for example, a para mono-alkyl phenol or an olefinic polymer derived from ethylenically unsaturated monomers which is oxidized to introduce carbonyl groups and associated active alpha hydrogens. These oxidized polymers are disclosed in U.S. Pat. Nos. 3,872,019 and 4,011,380 which are expressly incorporated by reference herein. These conventional Mannich additive compositions are highly effective in reducing the formation of harmful deposits on engine surfaces in four-cycle gasoline and diesel operation. Commercial conventional Mannich additives suffer the drawback that when used in high temperature or two-cycle engine operation they fail to provide sufficient anti-wear and anti-deposit properties to the lubricant to prevent formation of harmful deposits on engine surfaces at high temperatures. That Mannich additives have heretofore not been useful for two-cycle engine operation is unfortunate in view of the fact that Mannich additives are generally less expensive than polyamine derivatives of isostearic acid.

Generally in low temperature or four-cycle engines, lubricants are contained in a sump and are continually recirculated through the engine during engine operation. Unavoidably, small amounts of a lubricant are consumed in engine operation, with the bulk of the lubricant continually recirculating to lubricate and cool engine surfaces.

Air-cooled two-cycle gasoline internal combustion engines operate at temperatures about 95°-110° C. (175°-200° F.) higher than normal operating temperatures of two-cycle water-cooled engines. The lubricant for two-cycle engines is contained in a gasoline-lubricant mixture which is atomized in a carburetor. The moving parts in the engine acquire lubricant as the atomized mixture passes through the engine, leaving lubricating amounts of the additive-containing lubricant. The major portion of the fuel and lubricant mixture is ultimately consumed in the combustion of the fuel.

Polysubstituted alkyl phenols are well-known antioxidants for polymers, lubricants, fuels and other substances. However, to the best of my knowledge, the use of these phenol compounds to modify or derivatize Mannich products is unknown for improving anti-wear and anti-deposit properties of lubricants for operation at high engine temperatures. Ditertiary alkyl phenols are different than the para mono-alkyl (4-substituted) phenol compounds commonly used in making Mannich additives. 2,4- and 2,6-ditertiary alkyl phenol compounds and other disubstituted tertiary alkyl phenols have at least one ortho or one para position available for the Mannich reaction. Commonly, para mono-alkyl phenols are preferred in the Mannich reaction for reasons that (1) a large alkyl group, having a molecular weight from 300 to 6,000, provides oil solubility to the Mannich product, and (2) both the 2 and 6 positions are available for the Mannich condensation reaction, promoting complete reaction high molecular weights which provide the highest activity.

Stover, U.S. Pat. No. 4,025,316, discloses two-cycle lubricants comprising the Mannich reaction product of $C_8$–$C_{40}$ alkyl-substituted hydroxy aromatic compound, an aldehyde, and an amine. Stover also teaches the use of 0.01 to 1.0 wt. % of a phenolic such as 2,6-ditertiary butyl cresol to increase the oxidative stability of oils containing said Mannich reaction products. While these compounds reduce the formation of harmful deposits on engine surfaces, a continuing need exists for compounds which have improved anti-deposit and anti-wear activity.

Swieteik, U.S. Pat. No. 3,956,148, teaches improving the anti-oxidation property of lubricating oil by incorporating in the oil the reaction product of hexamethylenetetramine and a phenol, a methylene bisphenol, or a sulfurized phenol, said phenol having at least one unsubstituted 2,4 or 6 position. Hexamethylenetetramine is the condensation reaction product of ammonia and formaldehyde, and is used to provide both methylene links and amino methylene links between phenol compounds. The products commonly contain one amino group per mole of phenol compound. Since mononitrogen compounds used in the Mannich reaction will afford little detergent-dispersant activity these compounds suffer the disadvantage that the compounds made from hexamethylenetetramine provide little or no anit-wear or anti-deposit activity. The compounds do not contain polyamines which provide these properties. While these compounds have antioxidant activity, since the compounds are mononitrogen derivatives, they provide little or no ability to reduce wear or deposit formation.

Stephens, U.S. Pat. No. 4,000,112, and others disclose hindered phenol-substituted compounds as anti-oxidants. These compounds suffer the disadvantage that, while the compounds stabilize lubricant and additives to oxidative degradation, they provide little or no ability to reduce wear or deposit formation.

Accordingly, a need exists for new synthetic Mannich additives having the ability to provide reduced wear and prevent deposit formation on engine surfaces at high temperatures.

The general object of the invention is to improve the anti-wear and anti-deposit activity of synthetic Mannich additive compositions. Another object of the invention is to improve synthetic Mannich additive compositions for high-temperature lubrication. A further object of the invention is to provide a new, improved Mannich additive composition providing antiwear and anti-deposit activity to engines at high temperature and at low treatment concentrations. Other objects appear hereinafter.

We have found that the objects of this invention can be obtained by forming a Mannich additive from a ditertiary alkyl phenol, a polyamine, a formaldehydeyielding reagent, and a substantially hydrocarbon compound having at least one active or acidic hydrogen such as a para mono-alkyl phenol or an oxidized olefinic polymer. Other things being equal Mannich additives containing ditertiary alkyl phenol functional groups unexpectedly provide substantially increased anti-wear and anti-deposit activities at high operating engine temperatures.

One aspect of the invention comprises the reaction product of a ditertiary alkyl phenol compound, a formaldehyde-yielding reagent, a polyamine, and a substantially hydrocarbon compound having at least one acidic or active hydrogen such as a para mono-alkyl (4-alkyl) phenol or an oxidized olefinic polymer. Another aspect of the invention comprises a lubricant composition comprising a major portion of a lubricating oil and an effective amount of the reaction product. Still another aspect of the invention comprises a gasoline containing an effective amount of the lubricating oil composition and containing an effective amount of the reaction product.

The diteritary alkyl phenol useful for preparing the modified Mannich products of the invention are represented by the general formula:

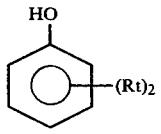

wherein each Rt is the same or different tertiary alkyl group. The preferred ditertiary alkyl phenol compounds, including phenol compounds commonly called "hindered" phenols, useful in this invention are 2,4-ditertiary alkyl phenols, and 2,6-ditertiary alkyl phenols, wherein each tertiary alkyl group can contain from about 4 to about 1,000 carbon atoms. These phenols are commercially available and economical to use. Useful tertiary alkyl groups are tertiary butyl, tertiary amyl, tertiary hexyl, tertiary eicosal, tertiary pentacosyl, tertiary pentacontyl, etc., or those derived from the alkylation reaction of a phenol compound with an olefinic polymer of ethylenically unsaturated monomer such as isobutylene, isoamylene, etc., said polymers having a molecular weight from about 300 to 10,000. The tertiary alkyl group can also be dervied from any hydrocarbon compound well-known in the art which will alkylate the phenol compound at the ortho or para positions. The tertiary alkyl group is a substantially aliphatic group that can contain nonaliphatic substituents such as fluoro, chloro, bromo, nitro, sulfide, etc. These substituents must be of a nature that the oil solubility of the compound is maintained. The important characteristic of the group is large steric hindrance. The size of the aliphatic group providing the steric hindrance about the hydroxyl group is characteristic of hindered phenols. Any alkyl group having size or steric hindrance equivalent to or greater than that of a tertiary butyl group can be used to produce the improved Mannich additives. However, as the size or steric hindrance of the group increases, the Mannich reaction rate of the phenol decreases. Thus, the preferred tertiary alkyl groups that provide both acceptable reaction rates and anti-wear and anti-deposit activity are tertiary butyl, tertiary amyl, tertiary hexyl, tertiary heptyl, tertiary octyl, tertiary nonyl and tertiary decyl.

Suitable Mannich additives are made from substantially hydrocarbon compounds containing at least one active or acidic hydrogen. Preferably for reasons of economy, availability, and ease of reaction, para-mono-alkyl (4-substituted) phenols and oxidized polymers derived from ethylenically unsaturated monomers are used. The alkyl group of the para-mono-alkyl phenol can contain from about 1 to about 1,000 carbon atoms. The alkyl group can be, for example, methyl, ethyl, isopropyl, propyl, butyl, isobutyl, tertiary butyl, amyl, isoamyl, tertiary amyl, hexyl, tertiary hexyl, decyl, isodecyl, tertiary decyl, eicosyl, pentacosyl, hectyl, polyethene substituted, polybutene substituted, polypropene substituted, etc. Phenol can be alkylated by olefinic alkylating agents to produce the para-mono-alkyl phenols in the presence of an alkylating catalyst such as $BF_3$, activated clays or ion exchange resin. About 20 to 1 moles of phenol can be contacted with one mole of the alkylating agent in the presence of the catalyst at a suitable elevated temperature, 90° C.–300° C. The product is separated from the catalyst, and distilled to remove phenol leaving the mono-alkyl phenol product. These olefinic alkylating agents are produced by the polymerization of ethylenically unsaturated monomers such as ethene, propene, 1-butene, 2-butene and isobutylene by well known polymerization techniques having molecular weights in the range of from about 300 to about 10,000.

Other substantially hydrocarbon compounds useful to produce Mannich products of the invention are oxidized olefinic polymers having a molecular weight from about 2,000 to about 10,000 derived from ethylene, propylene, ethylene-propylene, ethylene-propylene-diene monomers. The oxidation of these well known olefinic polymers introduces carbonyl groups into the polymer chain with associated active or acidic alpha hydrogens which are reactive in the Mannich reaction.

Polyamines useful for the production of the Mannich additives contain at least two nitrogen atoms, at least one of which is hydrogen bonded. Polyamines of the formula $NH_2(A\text{-}NH)_nH$ wherein A is an alkylene group having 2 to 6 carbon atoms and n is a number from one to six are particularly useful. Examples of preferred polyamines for reason of high activity, high performance and low cost of the finished lubricant additives are ethylene-diamine, diethylenetriamine, triethylenetetraamine, tetraethylenepentamine, 1,6-hexane diamine, etc. Other polyamines useful in the reaction are bis(aminopropyl)-piperazine, bis(aminopropyl)- ethylene diamine, and bis(aminopropyl)-propylene diamine.

A conventional formaldehyde-yielding reagent is useful for the preparation of these Mannich products. Examples of such formaldedhyde-yielding reagents are trioxane, paraformaldehyde, trioxymethylene, aqueous formalin, etc.

In somewhat greater detail, the Mannich products of this invention can be made by the reaction of a substantially hydrocarbon compound having at least one acidic or active hydrogen, ditertiary alkyl phenol, a formaldehyde-yielding reagent and a polyamine. The Mannich product can be derivatized with the hindered phenol functional group in at least two ways. (1) the ditertiary alkyl phenol can be reacted with the substantially hydrocarbon compound, the paraformaldehyde and the polyamine in a single one-step reaction or, (2) the ditertiary alkyl phenol and the formaldehyde-yielding compound can be reacted with the finished Mannich condensation product of the substantially hydrocarbon compound, the formaldehyde-yielding compound and the polyamine in a two-step reaction.

In the first instance, the substantially hydrocarbon compound having at least one active or acidic hydrogen, for example, a para-mono-alkyl phenol or oxidized olefinic polymer can be reacted with from about 0.1 to 10 moles of a ditertiary alkyl phenol, about 0.1 to 10 moles of a polyamine, and from about 0.2 to 20 moles of a formaldehyde-yielding reagent per mole of substantially hydrocarbon compound. Preferably the formaldehyde-yielding reagent is the last reactant to be added to the mixture. This sequence of the reaction produces the greatest yield of Mannich product and reduces the amount of resin by-products which may form. Formaldehyde-yielding reagent must be added in sufficient quantity to support the reaction of the tertiary alkyl phenol and the substantially hydrocarbon compound with the polyamine. For each mole of combined paraalkyl phenol and ditertiary alkyl phenol at least one mole of formaldehyde must be added. The reaction mixture is thoroughly mixed and heated to a temperature of from about 30° to about 300° C. to effect reaction. At the end of the reaction the mixture is stripped with a heated gas stream to remove water of condensation and other volatile components.

Alterntively, the tertiary alkyl phenol modified Mannich additives containing the ditertiary alkyl substituted phenol functional group can be prepared by reacting a Mannich product with the tertiary alkyl phenol and a formaldehyde-yielding reagent. In this instance, a substantially hydrocarbon compound containing at least one acidic or active hydrogen can be reacted with about 0.1 to 10 moles of a polyamine and from about 0.1 to 10 moles of formaldehyde-yielding reagent per mole of substantially hydrocarbon compound to form a Mannich product. This reaction mixture is heated from about 30 to about 300° C. to effect the condensation. The mixture is then stripped of volatiles by a heated inert gas stream. To the Mannich product is added from about 0.1 to about 10 moles of the ditertiary alkyl phenol and from about 0.1 to about 10 moles of a formaldehyde-yielding reagent. The reaction mixture is again heated to a temperature from about 30 to about 300° C. to effect the reaction. At the conclusion of the reaction the mixture is stripped with the heated gas and the product is recovered.

The reaction can be carried out in common aliphatic and aromatic solvents. Examples of useful solvents for the reactions discussed above are hexane, heptane, lingroin, distillate products, benzene, toluene, kerosene, gasoline, and lubricating oil fractions. The reaction is preferably carried out in a lubricating oil to facilitate blending the product into a lubricating oil or an oil based additive package.

The products can be prepared in continuous or batch equipment. In batch mode an amount of each reactant is charged to suitable reaction vessel and maintained and stirred at appropriate temperatures and pressures. The product is then placed in suitable strippers, filters and purification equipment. In continuous phase a stream of reactant or reactants are charged continuously to a vertical or horizontal rection zone maintained at an appropriate temperature, pressure and flow rate. The product stream is continuously withdrawn from the other end into appropriate purification equipment.

The various sequences of addition of the reactants forming the high temperature Mannich additive with the ditertiary alkyl phenol functional group appear to be equivalent in the production of the additive compositions of this invention. Apparently the various means of attaching the ditertiary alkyl phenol functional group to the Mannich additive through methylene groups are equivalent for increasing the high temperature lubricating activity of the products. We theorize that Mannich additives made with the ditertiary alkyl phenol functional group contain the ditertiary alkyl phenol functional group attached to the Mannich additive in one of two ways. Based on these assumptions two proposed molecular formulae of the many possible formulae for the tertiary alkyl phenol modified Mannich additives made with the ditertiary alkyl phenol are shown below:

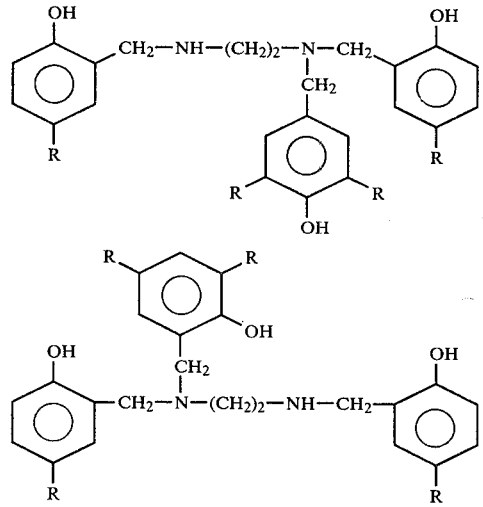

Further detail of the variations in the Mannich reaction are discussed in the patents incorporated above.

The modified Mannich products disclosed herein can be used in lubricating oil at a concentration of about 1.0 to 50.0 (wt)%, preferably 5 to 15 (wt)% based on the oil for highest performance at lowest cost. The lubricant containing the Mannich is dissolved in gasoline for use in two-cycle engines. About 1 part lubricant is used per 1 to 200 parts gasoline. The two-cycle engines currently in use require 1 part lubricant to about 25 to 150 parts gasoline depending on the engine.

Hydrocarbon oils useful for preparing the lubricants of this invention include generally solvent-refined clean-burning petroleum oils having relatively low viscosity. Commonly about 5W to 30W oils can be used. Highly preferable oils have low viscosity, about 50 to 90 SSU at 210° F., a viscosity index of 50 to 90, and low Conradson carbon residue.

Any commercially available gasoline can be used, however some engines can require leaded while others can require unleaded.

The use of this additive composition in two-cycle engines contemplates the use of various other additives in conjunction with the improved Mannich additive disclosed herein. Useful co-additives are calcium or magnesium sulfonate, sulfurized phenates, and the reaction product of an alkyl succinic anhydride and a polyamine as a rust inhibitor. The alkenyl succinic acid anhydride can have a low molecular weight from about 300 to about 6,000 and various polyamines can be used as discussed above. From about 0.1 to about 10 weight percent based on the lubricant of these co-additives in conjunction with about 0.1 to 50 weight percent based on the lubricant of the modified Mannich product can be used in two-cycle engines. Various other additives can also be used beneficially in conjunction with a modified Mannich additive.

The hot tube test is commonly used to evaluate the antideposit properties of additives. In the hot tube test, a test oil formation commonly containing 13.0 (wt)% of the modified Mannich product and heated $NO_X$ are passed upward through 2 mm capillary tube heated in an aluminum block. The test oil is consumed in the test, and the ability of the additive to prevent deposits is rated by the amount of dark colored deposits left on the tube at the end of the test. The deposits are rated from 10 (clear and colorless) to 1 (dark, black and opaque).

EXAMPLE I

Into a 500 ml 3-neck distilling flask equipped with a heating mantle, stirrer, Dean-Stark trap, thermometer, and nitrogen atmosphere was charged 200 gms (0.137 moles) of a polybutenyl phenol ($\overline{Mn}$=936) 64% active in oil solution, 20 g 5W oil, 6.17 g (0.013 moles) ethylenediamine, and 2 drops of an antifoam agent. The mixturre was stirred and heated to 100° C. (210° F.) and 11.1 g (0.317 moles) 37.0 (wt)% aqueous formalin were added. The temperaature was maintained at 100° C. (210° F.) for 30 minutes, and then raised to 155° C. (300° F.). A stream of nitrogen was passed through the mixture for 2 hours to strip volatiles. To the stripped reaction mixture was added dropwise 14.1 g (0.0685 moles) of 2,6-ditertiary butyl phenol and 5.6 gm (0.0685 moles) of 37% aqueous formalin. The mixture was maintained at 155° C. (300° F.) for 1 hour as volatiles were again stripped with a nitrogen stream. The product had an activity of 60.1 (wt)%, a nitrogen content of 0.864% and a viscosity at 100° C. (210° F.) of 2536 SSU.

EXAMPLE II

Into a 500 ml 3-neck flask equipped with a heating mantle, stirrer, Dean-Stark trap, thermometer and nitrogen atmosphere were charged 200 grams (0.137 moles) of a polybutyl phenol molecular weight (Mn of 936) 64% active in 5W oil, 20 gm 5W oil, 5.64 gm (0.027 moles) 2,6-ditertiary butyl phenol, 4.91 gm (0.0818 moles) of ethylene diamine and 2 drops of an antifoam agent. The mixture was heated to 100° C. (210° F.) for 30 minutes and 13.3 gm (0.164 moles) of 37% aqueous formalin were added dropwise. The mixture was sparged with nitrogen at 155° C. (300° F.) to remove volatiles for 3 hours. The product was 60% active, contained 0.618 (WT)% nitrogen and had a viscosity of 3636 SSU at 100° C. (210° F.).

EXAMPLE III

Example II was repeated except with 14.1 g (0.0685 moles) of 2,6-ditertiary butyl phenol instead of the 5.64 gm of the 2,6-ditertiary butyl phenol, 16.7 gm (0.205 moles) of 37% aqueous formalin instead of the 13.3 gm of formalin, and 6.17 gm (0.102 moles) ethylenediamine in place of the 4.91 gms of ethylene diamine.

EXAMPLE IV

Example II was repeated with 28.2 gm (0.14 moles) of 2,4-ditertiary butyl phenol, 8.22 gms (0.137 moles) ethylene diamine and 11.1 grams (0.137 moles) of 37% formalin in place of the 5.64 gm (0.027 moles) of the 2,6-ditertiary butyl phenol, 4.91 gm (0.0825 moles) ethylenediamine and 13.3 gm (0.164 moles) of aqueous formalin.

EXAMPLE V

Example II was repeated with 42.3 gms (0.205 moles) 2,6-ditertiary butyl phenol, 8.22 gm (0.137 moles) ethylenediamine and 11.1 gm (0.137 moles) 37% aqueous formalin in place of the 5.64 gm (0.027 moles) of the 2,6-ditertiary butyl phenol, 4.91 gm (0.0825 moles) ethylene diamine and 13.3 gms (0.164 moles) of 37% active formalin.

EXAMPLE VI

Example II was repeated except without the 5.64 gms (0.027 moles) 2,6-ditertiary butyl phenol and with 11.1 gms (0.137 moles) of formalin in place of the 13.3 gms (0.164 moles) of formalin.

Table I

| Hot Tube Tests ($NO_x$) Product of Example | | | |
|---|---|---|---|
| | (moles polybutyl phenol:moles di-t-butyl phenol) | Temperature 218° C. (425° F.) | Temperature 257° C. (495° F.) |
| IV | (1:1) | 7.5 (Ave.) | 3.2 (Ave.) (10 = max.) |
| III | (2:1) | 6.0 | 1.7 |
| I | (2:1) | 6.5 | 1.7 |
| II | (5:1) | 4.0 | 1.5 |
| VI | (blank, no di-t-butyl-phenol) | 2.0 | 1.0 |
| VI* | (1:0) | 9.0 | 3.0 |

*Also containing 0.23 moles of 2,6-ditertiary butyl-4-dodecyl phenol.

An examination of Table I shows that the Mannich products having hindered phenol functional groups (Examples I, II III, IV) have improved properties over the Mannich compound without the hindered phenol functional groups (Example VI).

The products of Examples I, II, III, and IV are also expected to be effective in reducing formation of deposits and wear in the standard Yamaha two-cycle engine and BIA tests, and to be superior to the unmodified Mannich of Example VI.

Since many embodiments of this invention may be made and many modifications of the embodiments may also be made, the foregoing is a detailed explanation and illustration. The invention resides in, and is defined by the claims appearing hereinafter.

I claim:

1. A composition comprising the Mannich reaction product of a ditertiary alkylphenol, formaldehyde or a formaldehyde-yielding compound, a polyamine, and a substantially hydrocarbon compound having at least one active or acidic hydrogen comprising a para-mono-alkylphenol or an oxidized olefinic polymer, wherein the reaction product is formed a a temperature of about 30° C. to 300° C.

2. The composition of claim 1 wherein the ditertiary alkyl phenol is reacted with the product of the reaction of the formaldehyde-yielding reagent, the polyamine and the substantially hydrocarbon compound.

3. The composition of claim 1 wherein the ditertiary alkyl phenol comprises a 2,4-ditertiary alkyl phenol or a 2,6-ditertiary alkyl phenol.

4. The composition of claim 1 wherein the tertiary alkyl groups of the ditertiary alkyl phenol are independently selected from the group consisting of tertiary butyl, tertiary pentyl, tertiary hexyl, tertiary heptyl, tertiary octyl, tertiary nonyl, tertiary decyl.

5. The composition of claim 1 wherein the alkyl group in the para-mono-alkyl phenol has a molecular weight from about 120 to about 6,000.

6. The composition of claim 1 wherein the substantially hydrocarbon compound having at least one acidic or active hydrogen comprises a para alkyl phenol comprising a polybutene substituted phenol or a polypropene substituted phenol.

7. A lubricant comprising a major proportion of a lubricating oil and an effective anti-deposit and anti-wear amount of the composition of claim 1.

8. A gasoline containing an effective anti-deposit and anti-wear amount of the lubricant of claim 7.

* * * * *

CERTIFICATE OF CORRECTION

Patent No. 4,242,212 Dated December 30, 1980

Inventor(s) Joseph B. Hanson

It is certified that error appears in the above-identified patent and that said Letters Patent are hereby corrected as shown below:

Column 3, line 19, "formaldehydeyielding" should read --formaldehyde-yielding--.

Column 3, line 41, "diteritary" should read --ditertiary--.

Column 3, line 66, "dervied" should read --derived--.

Column 5, line 14, "ways." should read --ways:--.

Column 6, line 14, "rection" should read --reaction--.

Column 7, lines 2 and 3, "solvent-refined clean-burning" should read --solvent-refined, clean-burning--.

Column 7, line 31, "through 2 mm" should read --through a 2 mm--.

Column 7, line 43, "0.013 moles" should read --0.103 moles--.

Column 7, line 46 "0.317 moles" should read --0.137 moles--.

Column 7, line 63, "Mn" should read --$\overline{M}$n--.

Column 8, line 4, "WT" should read --wt--.

UNITED STATES PATENT OFFICE

CERTIFICATE OF CORRECTION

Patent No. 4,242,212 Dated December 30, 1980

Inventor(s) Joseph B. Hanson

It is certified that error appears in the above-identified patent and that said Letters Patent are hereby corrected as shown below:

Column 8, line 41, "Product of Example" should be underlined and placed over the left two columns of Table I.

Column 8, line 56, "II III" should read --II, III--.

Column 9, line 8, "formed a a" should read --formed at a--.

Signed and Sealed this

Nineteenth Day of October 1982

[SEAL]

Attest:

GERALD J. MOSSINGHOFF

Attesting Officer

Commissioner of Patents and Trademarks